US008739921B1

(12) United States Patent
Larson

(10) Patent No.: US 8,739,921 B1
(45) Date of Patent: Jun. 3, 2014

(54) SEALING, ABSORBING, AND DECOUPLING SPEAKER RING KIT

(71) Applicant: Benjamin Leslie Larson, Sartell, MN (US)

(72) Inventor: Benjamin Leslie Larson, Sartell, MN (US)

( * ) Notice: Subject to any disclaimer, the term of this patent is extended or adjusted under 35 U.S.C. 154(b) by 0 days.

(21) Appl. No.: 13/925,774

(22) Filed: Jun. 24, 2013

(51) Int. Cl.
*H04R 1/02* (2006.01)

(52) U.S. Cl.
USPC ..... 181/199; 181/150; 381/389

(58) Field of Classification Search
CPC ..... B60R 11/0217; H04R 1/2896; H04R 2499/13
USPC ..... 181/150, 199; 381/87, 386, 389
See application file for complete search history.

(56) References Cited

U.S. PATENT DOCUMENTS 4,852,178 A * 7/1989 Inkman et al. ..... 381/395
5,138,656 A * 8/1992 Shanes ..... 379/167.11
5,734,732 A * 3/1998 Lemmon ..... 381/386
5,739,481 A * 4/1998 Baumhauer et al. ..... 181/148
6,505,705 B1 * 1/2003 Espiritu et al. ..... 181/150
6,843,345 B2 * 1/2005 Koizumi et al. ..... 181/150
6,876,743 B2 * 4/2005 Asahina et al. ..... 379/433.02
7,206,422 B2 * 4/2007 Akens et al. ..... 381/189

* cited by examiner

*Primary Examiner* — Jeremy Luks
(74) *Attorney, Agent, or Firm* — Steven Fisher-Stawinski; Robert W. Gray; The Gray Law Group, Ltd

(57) ABSTRACT

An acoustic system kit for a vehicle speaker and associated methods of installation and manufacture are disclosed. A drum of open-cell foam, preferably several inches thick, having a peel-and-stick pressure-sensitive adhesive backing is cut with two concentric circles to create an outer ring, and inner ring, and a core. The parts are sized to correspond in diameter, respectively, to the front edge, rear edge, and back disc of a particular size of speaker. The inner ring is cut circumferentially to reduce its height to a thin strip relative to the outer ring and drum. Using the pressure-sensitive adhesive, the core is affixed to the inside wall of vehicle door directly behind the door's speaker mount, the inner ring is affixed to the rear edge of a speaker to be installed, and the outer ring is affixed to front edge of the speaker. The speaker is then installed on its mount.

20 Claims, 2 Drawing Sheets

SEALING, ABSORBING, AND DECOUPLING SPEAKER RING KIT

CROSS-REFERENCE TO RELATED APPLICATIONS

Not Applicable

STATEMENT REGARDING FEDERALLY SPONSORED RESEARCH OR DEVELOPMENT

Not Applicable

PARTIES TO A JOINT RESEARCH AGREEMENT

Not Applicable

REFERENCE TO SEQUENCE LISTING, A TABLE, OR A COMPUTER PROGRAM LISTING COMPACT DISK APPENDIX

Not Applicable

BACKGROUND OF THE INVENTION

The invention relates general to acoustic systems and in particular to acoustic systems for installation with vehicle speakers. Sound systems of various kinds have long been standard original equipment in new cars, trucks, and other vehicles, and enhanced sound systems that provide improved quality over standard equipment have long been available on an aftermarket and dealer installed basis. Many vehicle sound systems of both the original equipment and aftermarket variety include speakers housed inside of the vehicle door.

Conventional vehicle door housings do not provide optimal acoustics for the speaker, and instead direct an unnecessary amount of the speaker's output energy into vibration of the door panel and into the outside environment, rather than into the vehicle cabin where the sound is desired.

An improved acoustical system would direct desirable output energy as high fidelity sound waves into the vehicle cabin while dampening or reflecting waves directed toward the outside environment or into the door panel. The improved acoustical system would ensure that a shock-absorbing material is present between the rear of the speaker and the inner surface of the outer shell of the vehicle door, between the speaker and its mount, and between the speaker and its grille.

SUMMARY OF THE INVENTION

Accordingly, an acoustic system kit for a vehicle speaker and associated methods of installation and manufacture are disclosed. A drum of open-cell foam, preferably several inches thick, having a peel-and-stick pressure-sensitive adhesive backing is cut with two concentric circles to create an outer ring, an inner ring, and a core. The parts are sized to correspond in diameter, respectively, to the front edge, rear edge, and back disc of a particular size of speaker. The inner ring is cut circumferentially to reduce its height to a thin strip relative to the outer ring and drum. Using the pressure-sensitive adhesive, the core is affixed to the inner surface of the outer shell of the vehicle door, directly behind the door's speaker mount; the inner ring is affixed to the rear edge of a speaker to be installed, and the outer ring is affixed to the front edge of the speaker. The speaker is then installed on its mount.

When installed in the disclosed configuration, the speaker is mechanically decoupled from its mount. The space surrounding the speaker, both backward to the inner surface of the outer shell of the vehicle door and forward to the speaker grill, is sealed so that sound waves will be directed only outward through the grille. Sound waves and vibrations that are not reflected outward are absorbed by the foam components.

It is an object of the invention to provide an absorbing, sealing, and decoupling acoustic system for a door-mounted vehicle speaker.

It is an object of the invention to provide an absorbing, sealing, a decoupling acoustic system for a speaker mounted in a location other than a vehicle door that is characterized by having a speaker grille that is not normally in contact with the speaker housing.

It is an object of the invention to provide an acoustic system for a speaker that is readily and inexpensively manufactured.

It is an object of the present invention to provide an acoustic system for a speaker that is quickly and easily installed, without requiring special tools.

Additional features and advantages of the invention will be set forth in the description which follows, and will be apparent from the description, or may be learned by practice of the invention. The foregoing general description and the following detailed description are exemplary and explanatory and are intended to provide further explanation of the invention.

BRIEF DESCRIPTION OF THE DRAWINGS

The accompanying drawings are included to provide a further understanding of the invention and are incorporated into and constitute a part of the specification. They illustrate one embodiment of the invention and, together with the description, serve to explain the principles of the invention.

DETAILED DESCRIPTION OF THE INVENTION

Figure 3:
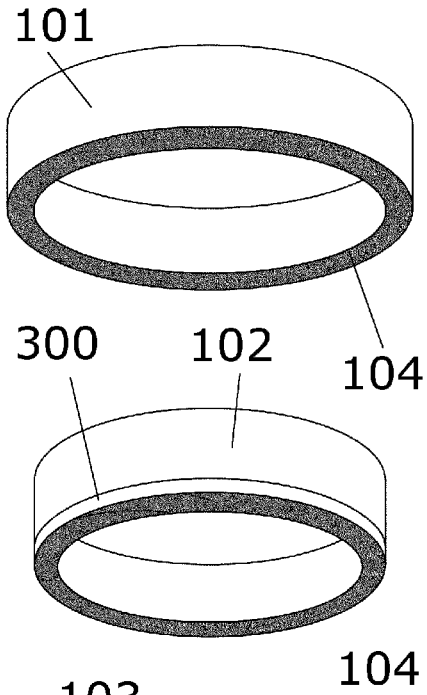
FIG. 3 shows an exploded view of the first exemplary embodiment as the components are initially separated, displaying the outer ring 101, inner ring 102, core 103, pressure-sensitive adhesive backing 104, and inner ring cut plane 300.

Referring now to the invention in more detail, the invention is directed to an acoustic system kit for a vehicle door speaker or other speaker and associated methods of installation and of manufacture. FIG. 3 shows the kit components of the first exemplary embodiment. The kit components are an outer ring 101, and inner ring 102, and a core 103; each component is made of a foam material and has a peel-and-stick pressure sensitive adhesive backing 104 applied to its bottom face. The inventor has observed that 1.8 lb open-cell foam is the preferred material; other densities of open-cell foam are acceptable, and closed-cell foam is generally unacceptably rigid, though some densities may be acceptable. Other shock-absorbing materials may be used as well.

Figure 4:
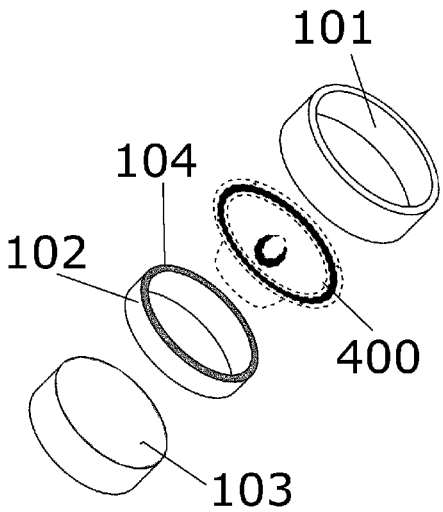
FIG. 4 shows an exploded view of the first exemplary embodiment as applied to a vehicle speaker 400 (not a part of the invention and shown in dashed lines for context only), displaying the outer ring 101, inner ring 102, core, 103, and pressure-sensitive adhesive backing 104.
Figure 5:
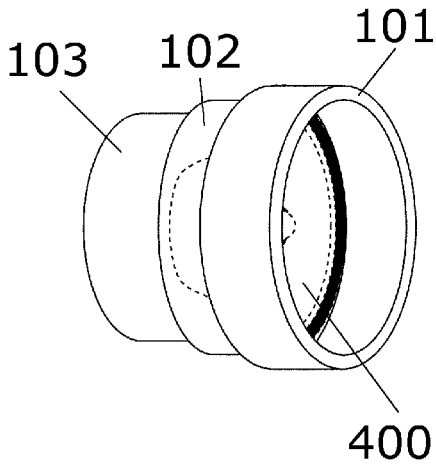
FIG. 5 shows a perspective view of the first exemplary embodiment as applied to a vehicle speaker 400 (not a part of the invention and shown in dashed lines for context only), displaying the outer ring 101, inner ring 102, core, 103.
Figure 6:
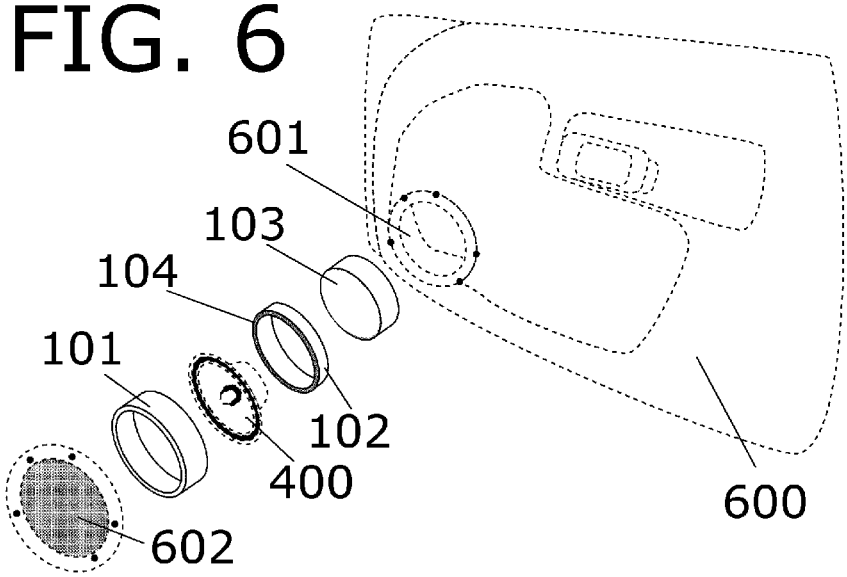
FIG. 6 shows an exploded view of the first exemplary embodiment as applied to a vehicle door 600 having a speaker mount ring 601, speaker 400, and speaker grille cover 602 (all not parts of the invention and shown in dashed lines for context only), displaying the outer ring 101, inner ring 102, core, 103, and pressure-sensitive adhesive backing 104.

Preferable sizes of the outer ring 101, the inner ring 102, and the core 103 are determined by the size of a particular speaker to be installed in a particular mounting location, for example the speaker 400 mounted in the vehicle door 600 of FIGS. 4-6. The diameter and radial thickness of the outer ring 101 correspond to the diameter and radial thickness of the front edge of the speaker 400. The diameter and radial thickness of the inner ring 102 corresponds to the diameter and radial thickness of the rear edge of the speaker 400. The diameter and radius of the core correspond to the space provided within the speaker mount 601. The axial thickness of the inner ring 102 is preferably thin compared to the outer ring 101 and core 103; the inventor has observed that one-quarter inch thickness is optimal. As shown in FIG. 3, the inner ring 102 is cut along a plane 300 to achieve the desired axial thickness. The axial thicknesses of the outer ring 101 and core 103 may be equal or unequal, and may be several inches in length. The axial thickness of the outer ring is preferably greater than the distance from the front edge of the speaker 400 to the inside surface of the speaker grille cover 602. The axial thickness of the core 103 is preferably greater than the distance from the back of the speaker 400 to inner surface of the outer shell of the vehicle door 600 or other enclosure.

Figure 1:
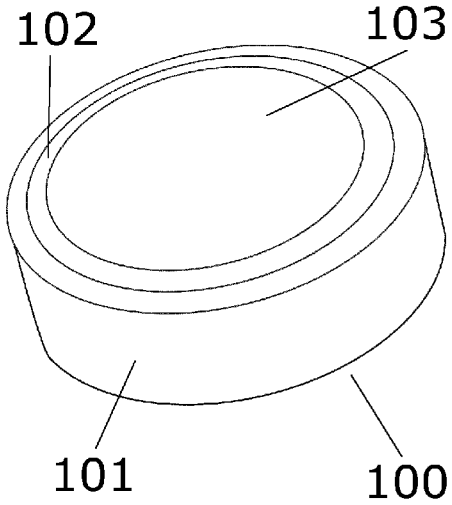
FIG. 1 shows an elevated of the first exemplary embodiment as initially manufactured, displaying the foam drum 100, outer ring 101, inner ring 102, and core 103.
Figure 2:
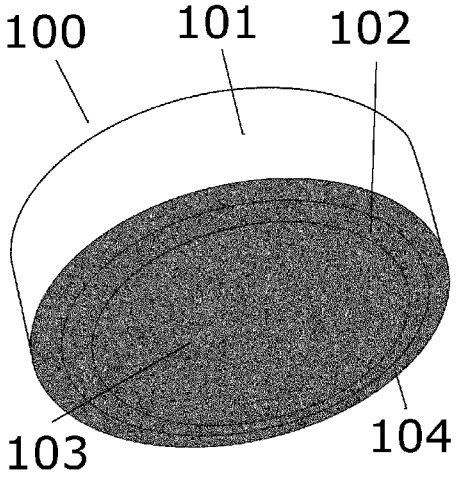
FIG. 2 shows a lowered view of the first exemplary embodiment as initially manufactured, displaying the foam drum 100, outer ring 101, inner ring 102, core 103, and pressure-sensitive adhesive backing 104.
Figure 2:
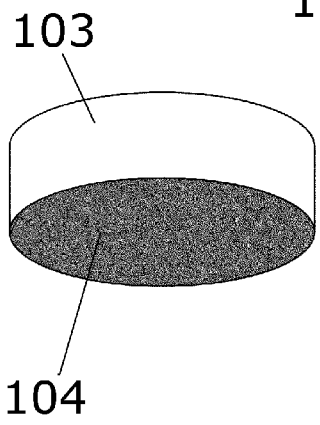

To manufacture the kit, a drum 100 of foam material is produced as per FIGS. 1-2. As discussed above, the foam is preferably 1.8 lb open cell foam, though other weights of open cell foam and other shock-absorbent materials may be used. A peel-and-stick pressure-sensitive adhesive backing 104 is applied across the bottom of the drum 100. Such peel-and-stick pressure sensitive adhesives are well-known in the prior art and are preferred, however other types of adhesives (both pressure-sensitive and non-pressure-sensitive types and both peel-and-stick types and types that are applied from a bulk quantity at the time of installation) may also be used. The drum 100 is preferably of diameter equal to the desired outer diameter for the outer ring 101, equal to the outer diameter of the front edge of the speaker 400. The drum 100 is preferably several inches thick axially, and is preferably of an axial thickness at least equal to the greater of the distance from the back of the speaker 400 (the minimum preferable axial thickness for the drum 103) and the distance from the front edge of the speaker 400 to the speaker grille cover 602.

After the drum 100 is formed, it is cut axially through its entire thickness in two concentric circles, both centered about the axial line of the drum 100. The diameter of the first cut is equal to the desired inner diameter of the outer ring 101 and the outer diameter of the inner ring 102, equal to the inner diameter of the front edge of the speaker 400. The diameter of the second cut is equal to the desired inner diameter of the inner ring 102 and the diameter of the core 103.

After cutting in concentric circles, the drum 100 may be separated into the constituent outer ring 101, inner ring 102, and core 103, and the inner ring 102 may be cut along a plane 300 to achieve the desired reduced axial thickness, preferably one quarter inch. The side of the inner ring 102 having the pressure-sensitive adhesive backing 104 is cut to thickness, and the remaining scrap side is discarded. The drum 100 may be considered a finished manufactured product or kit prior to separation into the constituent components or the cutting to axial thickness of the inner ring 102. Alternatively, the separation and cutting steps may be performed at the time of manufacture.

If the separation and cutting steps are not conducted at the time of manufacture, then the installation begins by separating the outer ring 101, inner ring 102, and core 103, and cutting the inner ring 102 to axial thickness as described above. If these steps have been performed at the time of manufacture, then they are omitted.

To proceed installing the invention, the user prepares the installation site. In the example of a vehicle door installation, the vehicle door is disassembled as per FIG. 6 with the speaker grille cover 602 and any other intervening panels removed to expose the speaker mount 601 and the space behind it. Alternative installation sites include any installation site where a speaker is fitted to a circular mount without being in mechanical contact with the surface behind or a grille-cover in front. The user prepares the site by thoroughly cleaning the speaker mount 601, the region of the inner wall of the vehicle door 600 (or other housing) that is directly behind the speaker mount 601, and the inner surface of the speaker grille cover 602. The user also prepares the speaker 400 for installation by thoroughly cleaning its front and rear edge surfaces and rear disc surface.

Installation proceeds by removing the cover material from the peel-and-stick pressure-sensitive adhesive 104 of the core 103 and affixing to the inner wall of the vehicle door 600 (or other housing), directly behind the speaker mount 601. The cover material is then removed from the peel-and-stick pressure-sensitive adhesive 104 of the inner ring 102, and the inner ring 102 (already cut to the desired reduced axial thickness, preferably one quarter inch) is affixed to the rear edge of the speaker 400. Depending upon the speaker size and shape, the inner ring 102 may or may not conform exactly to the rear edge of the speaker 400 and may instead be narrower. Since the rear edge of the speaker 400 is generally conically shaped, it is generally possible to affix an inner ring 102 within a range of diameters and radial thicknesses. The speaker 400 is then mounted to the speaker mount 601 with standard fasteners and wired according to manufacturer instructions. The inner ring 102 should sit compressed between the speaker 400 and the speaker mount 601, and the core 103 should sit compressed between the rear disc of the speaker 400 and the inner surface of the installation site.

With the speaker in place, the cover material is removed from the peel-and-stick pressure-sensitive adhesive 104 of the outer ring 101, and outer ring 101 is affixed to front edge of the speaker 400. The grille cover 602 is placed over the speaker 400 loosely to test the installation as the installer observes the outer ring 101 to determine whether it folds over on itself or deforms excessively under the pressure of the grille cover 602. If the outer ring 101 folds over on itself or deforms excessively, then the outer ring 101 is cut to a reduced axial thickness at which such folding over or excessive deformation does not occur. The grille cover 602 is then installed normally using standard fasteners.

While the foregoing written description of the invention enables one of ordinary skill to make and use what is presently considered to be the best mode thereof, those of ordinary skill in the art will understand and appreciate the existence of variations, combinations, and equivalents of the specific embodiment, method, and examples herein. The invention should, therefore, not be limited by the above described embodiment, method, and examples, but by all embodiments and methods within the scope and spirit of the invention.

I claim:

1. A method of manufacturing an acoustic system kit, said acoustic system kit comprising:

(a) an outer ring;
(b) an inner ring;
(c) a core;
(d) said outer ring having the shape of a hollow cylinder having an outer circumferential surface, an inner circumferential surface, a top surface and a bottom surface;
(e) said inner ring having the shape of a hollow cylinder having an outer circumferential surface, an inner circumferential surface, a top surface and a bottom surface;
(f) said core having the shape of a cylindrical prism having an outer circumferential surface, a top surface, and a bottom surface;
(g) said outer ring being made of a first compressible material;
(h) said inner ring being made of a second compressible material;
(i) said core being made of a third compressible material;
(j) said outer ring having a first adhesive affixed to its bottom surface;
(k) said inner ring having a second adhesive affixed to its bottom surface;
(l) said core having a third adhesive affixed to its bottom surface;
(m) the inner diameter of said outer ring is equal to the outer diameter of said inner ring;
(n) the inner diameter of said inner ring is equal to the outer diameter of said core;
(o) said outer ring and said core are of equal axial thickness;

and said method of manufacturing comprising:

(a) producing a drum made of a compressible material;
(b) the axial thickness of said drum being equal to the intended axial thickness of said outer ring and said core;
(c) the outer diameter of said drum being equal to the intended outer diameter of said outer ring;
(d) applying an adhesive to the bottom surface of said drum; and
(e) making a first circular cut and a second circular cut in said drum;
(f) said first circular cut and said second circular cut both being parallel to the axial line of said drum;
(g) the diameter of said first circular cut being equal to the intended inner diameter of said outer ring and the intended outer diameter of said inner ring;
(h) the diameter of said second circular cut being equal to the intended inner diameter of said inner ring and the intended outer diameter of said core;

whereby said drum is separated into said outer ring, said inner ring, and said core.

2. The method of claim 1 further comprising the additional step of making a planar cut through said inner ring, said cut being orthogonal to the axial line of said inner ring, retaining the portion of said inner ring that has the bottom surface of said inner ring and discarding the portion of said inner ring that has the top surface of said inner ring such that said inner ring has reduced axial thickness relative to said outer ring and said core.

3. The method of claim 2 wherein the axial thickness of said inner ring is about one quarter inch.

4. The method of claim 1 wherein said compressible material is open-cell foam.

5. The method claim 4 wherein said open-cell foam is a 1.8 lb open-cell foam.

6. The method of claim 1 wherein said adhesive is a peel-and-stick pressure-sensitive adhesive.

7. The method of claim 3 wherein said adhesive is a peel-and-stick pressure-sensitive adhesive.

8. A method of installation of an acoustic system kit, said acoustic system kit comprising:

(a) an outer ring;
(b) an inner ring;
(c) a core;
(d) said outer ring having the shape of a hollow cylinder having an outer circumferential surface, an inner circumferential surface, a top surface and a bottom surface;
(e) said inner ring having the shape of a hollow cylinder having an outer circumferential surface, an inner circumferential surface, a top surface and a bottom surface;
(f) said core having the shape of a cylindrical prism having an outer circumferential surface, a top surface, and a bottom surface;
(g) said outer ring being made of a first compressible material;
(h) said inner ring being made of a second compressible material;
(i) said core being made of a third compressible material;
(j) said outer ring having a first adhesive affixed to its bottom surface;
(k) said inner ring having a second adhesive affixed to its bottom surface;
(l) said core having a third adhesive affixed to its bottom surface;
(m) the inner diameter of said outer ring is equal to the outer diameter of said inner ring;
(n) the inner diameter of said inner ring is equal to the outer diameter of said core;
(o) said outer ring and said core are of equal axial thickness;

and said method of installation comprising:

(a) identifying a speaker and a speaker installation site;
(b) said speaker installation site having a circular speaker mount;
(c) said speaker installation site having a surface behind said circular speaker mount that is not in mechanical contact with said speaker when said speaker is installed on said speaker mount;
(d) said speaker installation site having a grille-cover in front of said circular speaker mount that is not in mechanical contact with said speaker when said speaker is installed on said speaker mount;
(e) cleaning said speaker, said speaker mount, said surface behind said speaker mount, and said grille cover;
(f) affixing said core to said surface behind said speaker mount using said third adhesive;
(g) affixing said inner ring to the rear edge of said speaker using said second adhesive;
(h) installing said speaker;
(i) affixing said outer ring to the front edge of said speaker using said first adhesive;
(j) placing said grille-cover loosely while observing said outer ring;
(k) if said outer ring experiences excessive deformation or folding, making a planar cut in said outer ring;
(l) said planar cut in said outer ring being orthogonal to the axial line of said outer ring;
(m) said planar cut in said outer ring being positioned to reduce the axial thickness of said outer ring such that said outer ring no longer undergoes excessive deformation or folding upon placing said grille-cover; and
(n) installing said grille-cover.

9. The method of claim 8 further comprising the additional step of making a planar cut through said inner ring, said cut being orthogonal to the axial line of said inner ring, retaining the portion of said inner ring that has the bottom surface of said inner ring and discarding the portion of said inner ring that has the top surface of said inner ring such that said inner ring has reduced axial thickness relative to said outer ring and said core.

10. The method of claim 9 wherein the axial thickness of said inner ring is about one quarter inch.

11. The method of claim 8 wherein said compressible material is open-cell foam.

12. The method claim 11 wherein said open-cell foam is a 1.8 lb open-cell foam.

13. The method of claim 8 wherein said adhesive is a peel-and-stick pressure-sensitive adhesive.

14. The method of claim 12 wherein said adhesive is a peel-and-stick pressure-sensitive adhesive.

15. An acoustic system kit, said acoustic kit being the product of a method of manufacture, said acoustic system kit comprising:

(a) an outer ring;
(b) an inner ring;
(c) a core;
(d) said outer ring having the shape of a hollow cylinder having an outer circumferential surface, an inner circumferential surface, a top surface and a bottom surface;
(e) said inner ring having the shape of a hollow cylinder having an outer circumferential surface, an inner circumferential surface, a top surface and a bottom surface;
(f) said core having the shape of a cylindrical prism having an outer circumferential surface, a top surface, and a bottom surface;
(g) said outer ring being made of a first compressible material;
(h) said inner ring being made of a second compressible material;
(i) said core being made of a third compressible material;
(j) said outer ring having a first adhesive affixed to its bottom surface;
(k) said inner ring having a second adhesive affixed to its bottom surface;
(l) said core having a third adhesive affixed to its bottom surface;
(m) the inner diameter of said outer ring is equal to the outer diameter of said inner ring;
(n) the inner diameter of said inner ring is equal to the outer diameter of said core;
(o) said outer ring and said core are of equal axial thickness;

and said method of manufacture comprising:

(a) producing a drum made of a compressible material;
(b) the axial thickness of said drum being equal to the intended axial thickness of said outer ring and said core;
(c) the outer diameter of said drum being equal to the intended outer diameter of said outer ring;
(d) applying an adhesive to the bottom surface of said drum; and
(e) making a first circular cut and a second circular cut in said drum;
(f) said first circular cut and said second circular cut both being parallel to the axial line of said drum;
(g) the diameter of said first circular cut being equal to the intended inner diameter of said outer ring and the intended outer diameter of said inner ring;
(h) the diameter of said second circular cut being equal to the intended inner diameter of said inner ring and the intended outer diameter of said core;

whereby said drum is separated into said outer ring, said inner ring, and said core.

16. The acoustic system kit of claim 15 wherein said method of manufacture further comprises the additional step of making a planar cut through said inner ring, said cut being orthogonal to the axial line of said inner ring, retaining the portion of said inner ring that has the bottom surface of said inner ring and discarding the portion of said inner ring that has the top surface of said inner ring such that said inner ring has reduced axial thickness relative to said outer ring and said core.

17. The acoustic system kit of claim 16 wherein the axial thickness of said inner ring is about one quarter inch.

18. The acoustic system kit of claim 15 wherein said compressible material is open-cell foam.

19. The acoustic system kit of claim 18 wherein said open-cell foam is a 1.8 lb open-cell foam.

20. The acoustic system kit of claim 15 wherein said adhesive is a peel-and-stick pressure-sensitive adhesive.

* * * * *